US006739279B2

(12) United States Patent
Funk

(10) Patent No.: US 6,739,279 B2
(45) Date of Patent: May 25, 2004

(54) PORTABLE DOCK STRUCTURE

(76) Inventor: James E. Funk, 424 Poplar St., Norton, VA (US) 24273-1421

( * ) Notice: Subject to any disclaimer, the term of this patent is extended or adjusted under 35 U.S.C. 154(b) by 0 days.

(21) Appl. No.: 10/455,015

(22) Filed: Jun. 5, 2003

(65) Prior Publication Data

US 2003/0217681 A1 Nov. 27, 2003

Related U.S. Application Data

(63) Continuation-in-part of application No. 10/154,004, filed on May 23, 2002, now abandoned.

(51) Int. Cl.[7] ..... B63B 17/00
(52) U.S. Cl. ..... 114/362; 405/219; 14/71.1
(58) Field of Search ..... 14/71.5, 71.1; 114/230.1, 362; 405/219

(56) References Cited

U.S. PATENT DOCUMENTS

| | | | | | |
|---|---|---|---|---|---|
| 4,142,477 | A | * | 3/1979 | Powers | 114/263 |
| 4,293,967 | A | * | 10/1981 | Ord | 114/362 |
| 5,165,823 | A | * | 11/1992 | Cupples | 405/219 |
| 5,588,782 | A | * | 12/1996 | Haring | 405/218 |
| 6,067,926 | A | * | 5/2000 | Robinson | 114/362 |

* cited by examiner

*Primary Examiner*—Jesus D. Sotelo

(57) ABSTRACT

A portable dock structure for the temporary docking of boats, particularly of pontoon or houseboats and the like, the dock structure having a gangway having an anchor end adapted for securing the structure to the shore of a body of water and having a boat end adapted for affixing to a boat, a flotation device on the gangway adjacent the boat end whereby the boat end can be first floated from the shore out into the water and the anchor end then secured to the shore and then the boat end affixed to a boat to thereby provide a stable passageway between the boat and the shore.

16 Claims, 3 Drawing Sheets

PORTABLE DOCK STRUCTURE

This application is a continuation-in-part of applicants Ser. No. 10/154,004 of same title filed on May 23, 2002, now abandoned.

BACKGROUND OF THE INVENTION

1. Field

This invention concerns a unique structure for providing a temporary dock between the shore and a boat, especially a pontoon or house boat, wherein the dock structure is lightweight and easily handleable and portable.

2. Prior Art

Applicant is unaware of any prior art which is anticipatory of the presently claimed invention.

SUMMARY OF THE INVENTION

The invention in one of its preferred and broad embodiments comprises a portable dock structure for the temporary docking of boats, particularly of pontoon or houseboats and the like, said dock structure comprising a gangway section having an anchor end adapted for securing to the shore of a body of water and having a boat end adapted for affixing to a boat, flotation means on said gangway section adjacent said boat end whereby said boat end can be first floated from said shore out into said water and said anchor end then secured to said shore and then said boat end affixed to a boat to thereby provide a stable passageway between said boat and said shore.

BRIEF DESCRIPTION OF THE DRAWINGS

The invention will be further understood from the following description and drawings of preferred embodiments wherein the various figures are not drawn to scale or in actual proportions, and wherein certain structures are broken away or sectioned for clarity, wherein.

DETAILED DESCRIPTION

Figure 1:
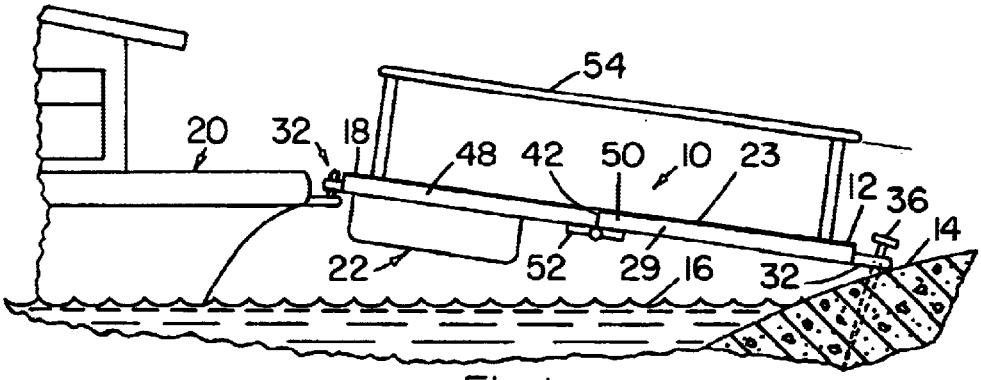
FIG. 1 is a side view of the present dock structure as affixed to a shore and to a houseboat.
Figure 2:
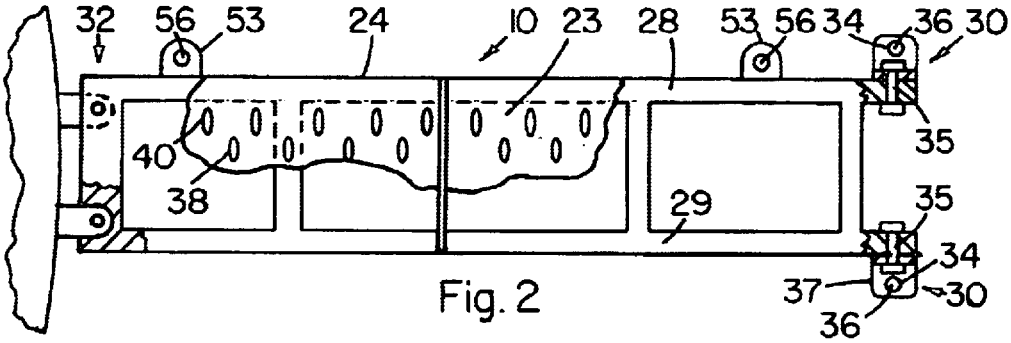
FIG. 2 is an enlarged top view of the depiction of FIG. 1.

Referring to the drawings and with reference to the claims hereof, the present portable dock structure comprises a gangway generally designated 10 having an anchor end 12 adapted for securing to the shore 14 of a body of water 16 and having a boat end 18 adapted for affixing to a boat 20, and flotation means 22 on said gangway adjacent said boat end.

The gangway is substantially rectangular in configuration and comprises an elongated substantially rectangular floor 23 having a pair laterally spaced side edge portions 24, 26, a pair of support beam means 28 and 29 are affixed to said edge portions and extend the full length thereof. The floor 23 and the beam means are of lightweight material, preferably aluminum. A pair of first bracket means 30 are affixed on said anchor end for receiving stake means 36, preferably very loosely, thru aperture 34 therein for removable attachment of said anchor end to said shore while allowing up and down movement of said best end. A second bracket means 32 is provided on said boat end for removable attachment of said gangway to a boat.

Figure 13:
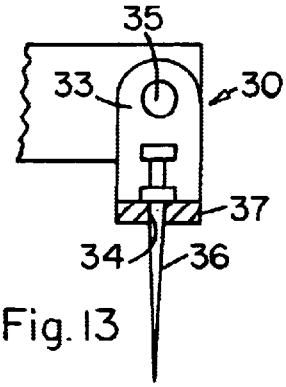
FIG. 13 shows another embodiment of the first bracket means.

In the embodiment of FIG. 13 a vertical section 33 of each bracket 30 is pivotally mounted on a support beam by pin 35 and an outwardly, substantially horizontal foot section 37 is apertured as at 34 to receive the stake 36. The pivot mechanism allows the dock to easily pivot up and down a sufficient distance to accommodate any drop, e.g., seasonal in water level. It is noted that for further stabilizing anchor end 12 of the dock, foot sections 37 may be extended laterally out from the dock sides any desirable further distance.

The floor 23 can be of any lightweight material and construction including a solid or meshed aluminum sheet or the like, but preferably is of expanded metal sheet aluminum having apertures 38 formed with serrated edges 40. Floor 23 and said beam means 28 and 29 which preferably are of square or rectangular aluminum tubing, are preferably sectioned and hinged at one or more locations such as 42 along their lengths to provide union means for the sections and allow the dock structure to be folded into a compact unit which can be readily transported on or in a vehicle.

Figure 3:
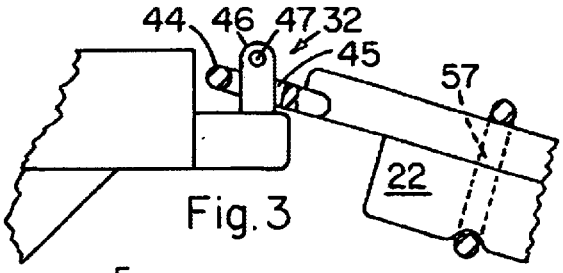
FIG. 3 is an enlarged side view with portions sectioned, of one embodiment of the boat end second bracket means as mounted on a cooperating joint component affixed to a boat.
Figure 6:
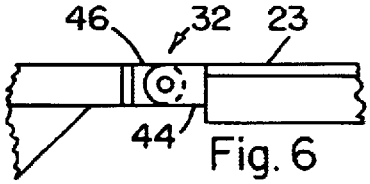
FIG. 6 is a side view of the boat end of the dock structure showing a variation of the second bracket means and a cooperating joint structure affixed to a boat.

The second bracket means generally designated 32 provides a first component 44 (an apertured plate in FIG. 3) of a mechanical joint 45 on said boat end wherein a cooperating second component 46 (a stud in FIG. 3 having a lock pin 47) of the joint is mounted on a boat, and wherein said components are readily detachable.

Figure 4:
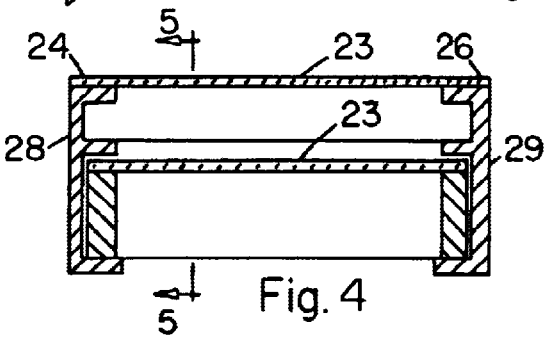
FIG. 4 is a lateral cross-sectional view of the dock structure as employing a sliding section, extension ladder type construction.
Figure 7:
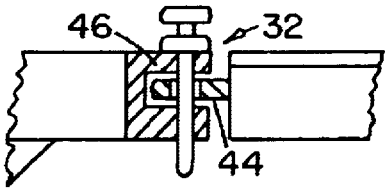
FIG. 7 is a view as in FIG. 6 showing another variation of the second bracket means and cooperating joint structure affixed to a boat.
Figure 5:
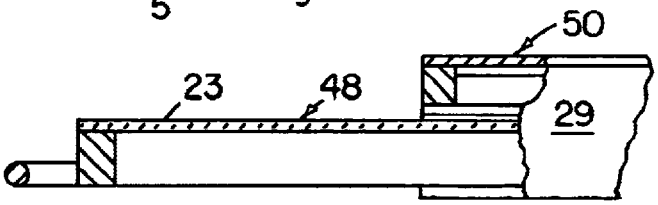
FIG. 5 is a side view, partially sectioned along line 5—5 of FIG. 4 of a portion of the dock structure of FIG. 4.

The joint 45 provides a hinge means to accommodate up and down movement of said boat. The floor and said beam means may comprise two or more sections such as 48 and 50 which are either hinged as at 52 or longitudinally slidably mounted together as shown in FIGS. 4 and 5 whereby said structure can be selectively elongated or shortened.

The beam means 28 and/or 29 may be provided with longitudinally spaced third bracket means 53, and wherein handrail means 54 are provided with posts 55 adapted to be inserted into sockets 56 in said third bracket means. The flotation means 22 preferably is provided with cooperating attachment components such as hooks and eyes or bunge cord 57 or the like for allowing quick connection and disconnection of said flotation means from said structure for transportation of said structure in a vehicle or the like. The flotation means preferably comprises Styrofoam or the like foamed polymer, or it can be an inflatable elastomeric device. It is preferably provided with cooperating connecting means.

Figure 9:
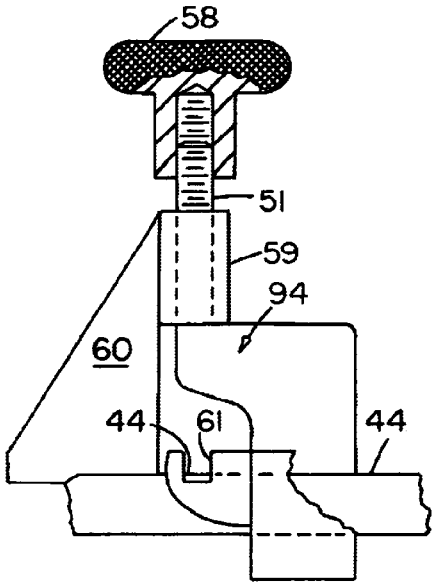
FIG. 9 is a front view of a preferred joint structure affixed to a boat and in its open, unlocked position.

Referring to FIGS. 9–12 a pair (or more) of said first components, i.e., rod or shaft members 44 are affixed to said boat end 18, e.g., by laterally spaced stud means 93, said shaft members being laterally spaced outwardly from the gangway boat end and oriented substantially horizontal and parallel thereto, and wherein said second component 46 comprises a saddle means 94 affixed to said boat and extending outwardly therefrom, each said saddle means being formed with a slot 95 into which said shaft sections can be dropped. Mounted on each saddle means is a clamping means 49 for securing said shaft sections within said slots. This clamping means comprises a stud 51 affixed to projection 93 and having a threaded upper end for threadedly receiving a tightening knob 58. A bushing 59 is slidably mounted on stud 51 and is welded to a clamping piece 60. As shown in FIG. 9, when bushing 59 with piece 60 are lifted up and pivoted around the stud (clockwise as shown by dotted line in FIG. 12), the shaft sections can be dropped down into slots 95. When bushing 59 and piece 60 are then rotated counterclockwise to the locking position where 60 drops down into a recess 61 in saddle means 94, knob 58 is tightened against the upper end of bushing 59 to lock 60 against shaft section 44.

Figure 10:
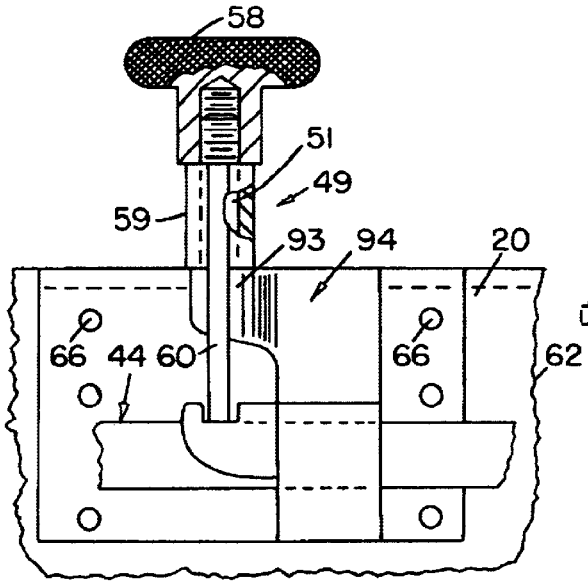
FIG. 10 is a front view of the joint structure of FIG. 9 in its closed and locked position.
Figure 12:
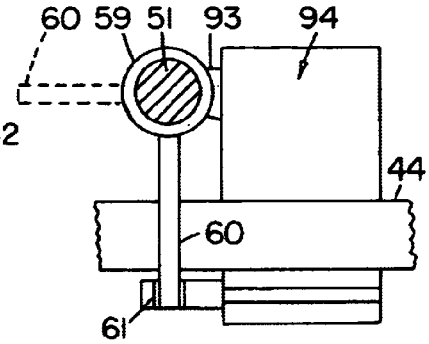
FIG. 12 is a top view of the joint structure of FIGS. 10 and 11 in its closed and locked position.
Figure 11:
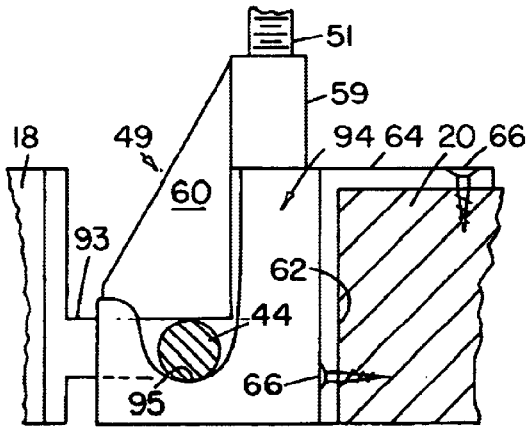
FIG. 11 is a side view of the joint structure of FIG. 10 in its closed and locked position.

As shown in FIGS. 10 and 11 the second bracket means, e.g., 94, preferably is affixed to a plate 62 which may have an upper section 64, both of which are bolted or screwed to the front deck portion of the boat as at 66.

Figure 8:
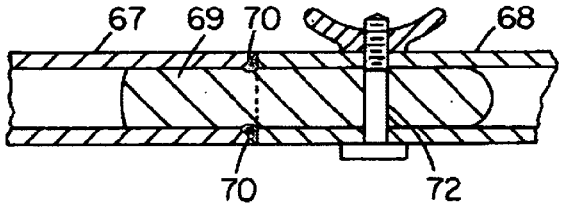
FIG. 8 is a cross-sectional view of one embodiment of joint structure which may be used to connect together sections of the gangway or handrail.

Referring to FIG. 8, a type of joint useful herein, particularly for joining tubular railing sections 67 and 68, comprises a stud 69 welded as at 70 to section 67 and hand pushed into section 68. A bolt such as 72 locks 68 and 69 together.

Figure 14:
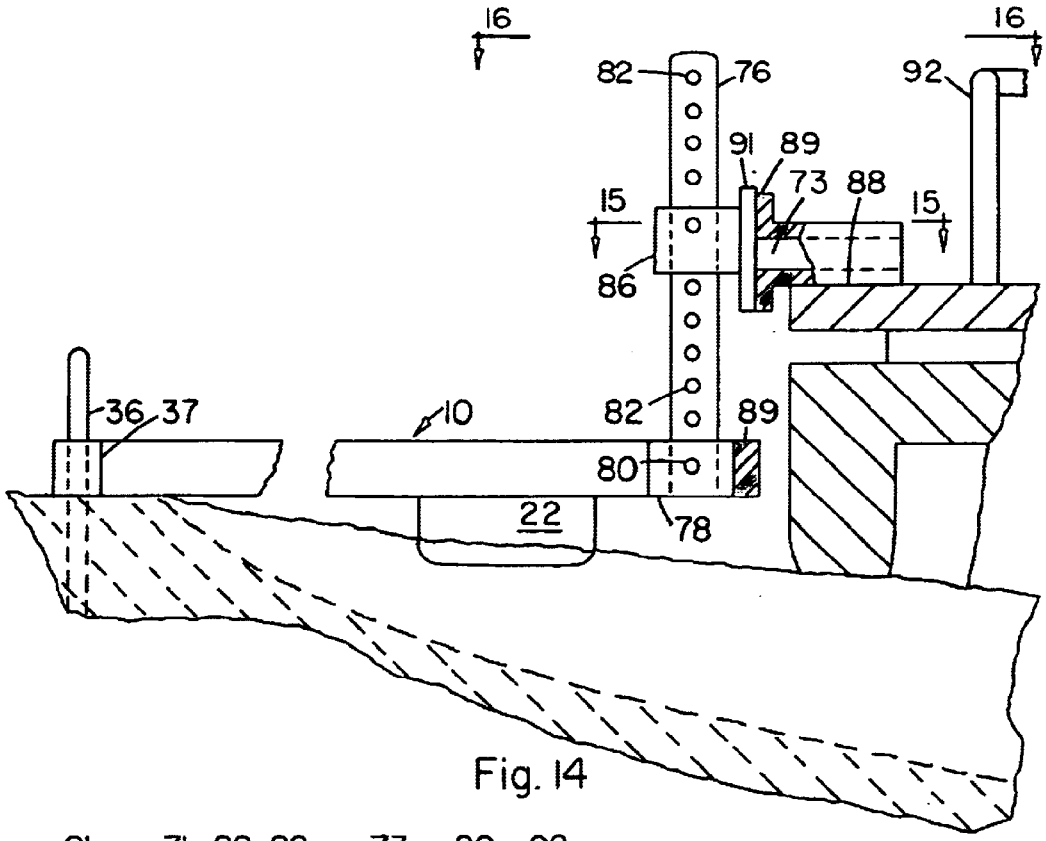
FIG. 14 is a side view of a most preferred embodiment of the present dock structure.
Figure 16:
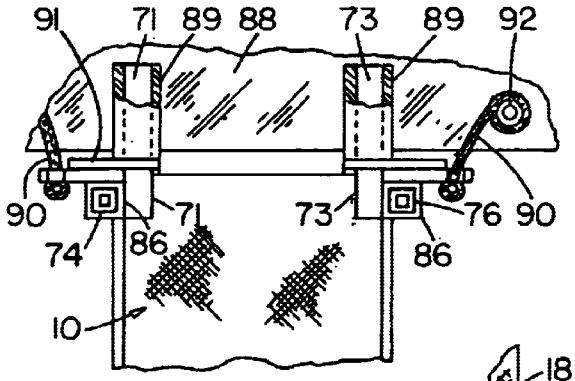
FIG. 16 is a cross-sectional view taken along line 16—16 in FIG. 14.
Figure 15:
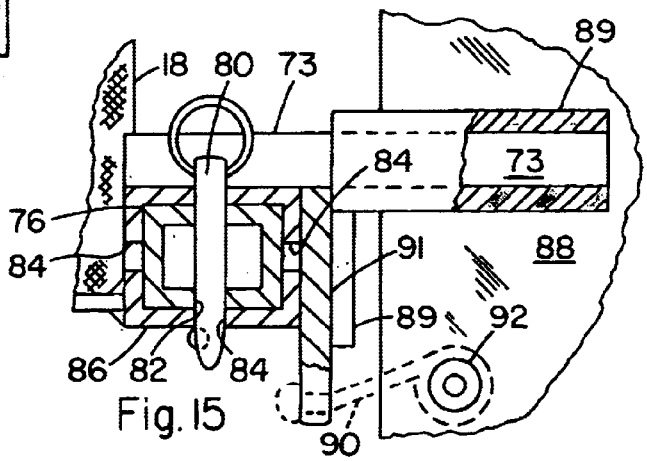
FIG. 15 is a cross-sectional view taken along line 15—15 in FIG. 14.

Referring to FIGS. 14–16, the most preferred construction for attaching boat end 18 of the gangway to the boat is shown as a comprising adjustable horizontal supports 71, 73 slidably, adjustably mounted on a pair of stanchions 74, 76 affixed to sockets such as 78 on the gangway end by pins 80 or the equivalent. These stanchions are provided with apertures 82 which are adapted to be aligned with aperture 84 in bearing members 86 such that a pin 80 or equivalent means can be inserted therethrough to fix the height of supports 71, 73 such that they will lie on the boat deck 88 or other permanent, generally horizontal fixed portion of the boat, with the gangway 10 and flotation means 22 floating on the water in a substantially horizontal posture. These height adjustment structures allow the dock to be positioned and fixed to the shore by staking or the like, with the boat end of the dock extending out into the water.

The height of the supports 71, 73 can then be adjusted to rest on the boat deck by a person standing on the boat end of the dock or by a person on the boat deck. With height adjustment made, tie lines such as 90 or the like affixed to plate members 91 on the gangway can be pulled tight to railings 92 or other structures on the boat to maintain proper contact of said supports with the deck.

So as not to abuse design features of the boat, elastomeric cushion material such as 89 is preferably affixed to boat contact portions of the supports and adjacent structures. It is noted that additional apertures 84 are provided in the other sides of bearing members 86 to allow either or both supports to be oriented at 90° to that shown such as to accommodate irregular shaped mooring portions of a boat, if needed.

It is noted that the present structure of adjustable support members which simply rest on the boat deck or equivalent platform means of a boat allows the boat to be readily slid out from under the supports after the tie lines are released.

This invention has been described in detail with particular reference to preferred embodiments thereof, but it will be understood that variations and modifications will be effected within the spirit and scope of the invention.

I claim:

1. A portable dock structure for the temporary docking of boats, particularly of houseboats, said structure comprising a gangway having an anchor end adapted for securing to the shore of a body of water and having a boat end provided with support means having rest segments adapted for lying on fixed portions of a boat for maintaining the relative vertical positions of said fixed portions and said boat end, flotation means on said gangway adjacent said boat end whereby said boat end can be first floated from said shore out into said water and said anchor end then secured to said shore and the said boat end then affixed to a boat to thereby provide a stable passageway between said boat and said shore, wherein said support means are mounted on said boat end and are height adjustable to accommodate varying heights of said fixed portions of a variety of boats or a rise or drop in water level while allowing a substantially horizontal posture of said gangway to be maintained.

2. The dock structure of claim 1 wherein said gangway as viewed from the top is substantially rectangular in configuration and comprises an elongated substantially rectangular floor having a pair of laterally spaced side edge portions, support beam means affixed to each said side edge portion and extending the full length thereof, said floor and beam means being of lightweight material, first bracket means on said anchor end for removable attachment of said gangway to said shore and allowing pivotal up and down movement of said boat end, wherein said support means comprises stanchion means having a vertical axis and being fixed to said boat end and extending substantially vertically therefrom, bearing means slidable up and down on said stanchion means, cooperating locking means on said stanchion means and said bearing means for adjustably fixing the vertical position of said bearing means, and wherein said rest segments are fixed to said bearing means and extend outwardly therefrom substantially normal to said vertical axis.

3. The dock structure of claim 2 wherein said first bracket means is apertured to loosely, slidably receive a stake means driven into said shore to anchor said anchor end thereto and accommodate up and down movement of said boat end.

4. The dock structure of claim 2 wherein said floor is of expanded metal sheet aluminum.

5. The dock structure of claim 2 wherein said floor and said beam means are provided in longitudinal sections, wherein cooperating elements of union means are provided on adjacent ends of said sections to allow quick joining or separating of said sections to allow said dock structure to be configured into a compact unit which can be readily transported on or in a vehicle.

6. The dock structure of claim 2 wherein said support means provides a first component of a mechanical joint for which a cooperating second component of said joint is mounted on a boat, and wherein said components are readily assembleable and detachable from each other.

7. The dock structure of claim 6 wherein said joint provides a hinge means to accommodate up and down movement of said boat.

8. The dock structure of claim 2 wherein said floor and said beam means comprise two or more sections which are longitudinally slidably mounted together whereby said structure can be selectively elongated or shortened.

9. The dock structure of claim 2 wherein said beam means are provided with longitudinally spaced third bracket means, and wherein handrail means are provided and adapted to be affixed to said third bracket means.

10. The dock structure of claim 1 wherein said structure and said flotation means are provided with cooperating connecting means for allowing quick connection and disconnection of said flotation means to and from said structure.

11. The dock structure of claim 5 wherein said union means comprises hinge means.

12. The dock structure of claim 6 wherein said first component comprises a rod member affixed to said boat end and having a shaft section spaced outwardly and oriented substantially horizontal and parallel thereto, and wherein said second component comprises a saddle means affixed to said boat and extending outwardly therefrom and formed with a slot into which said shaft section can be dropped, and clamping means on said saddle means for securing said shaft section within said slot.

13. The dock structure of claim 12 wherein said rod means extends across the front of said boat end and beyond said side edge portions to provide a said shaft section adjacent each said side portion, and wherein a pair of said second components are affixed to said boat and spaced apart a distance equal to the spacing of said shaft sections.

14. The dock structure of claim 2 wherein said gangway is entirely of aluminum.

15. The dock structure of claim 2 wherein said first bracket means comprises a bracket member pivotally secured to the outer side of each said beam means, wherein each said member is formed with a laterally extending foot plate thru which an aperture is provided for receiving an anchor stake to be driven into the ground.

16. The dock structure of claim 2 wherein the gangway is from about six feet to about ten feet in length and is from about 18 in., to about 24 in., in width.

* * * * *